US005399606A

United States Patent [19]

König et al.

[11] Patent Number: 5,399,606

[45] Date of Patent: Mar. 21, 1995

[54] THERMOSETTING PLASTIC POWDER MIXTURES

[75] Inventors: Michael König; Achim Hansen, both of Iserlohn; Arno Gardziella, Witten; Josef Suren, Haaren, all of Germany

[73] Assignee: Rutgerswerke Aktiengesellschaft AG, Germany

[21] Appl. No.: 138,350

[22] Filed: Oct. 18, 1993

[30] Foreign Application Priority Data

Oct. 28, 1992 [DE] Germany ..... 42 36 284.9

[51] Int. Cl.[6] ..... C08K 5/01; C08K 5/02

[52] U.S. Cl. ..... 524/385; 524/423; 524/485

[58] Field of Search ..... 524/385, 485, 423

[56] References Cited

FOREIGN PATENT DOCUMENTS 2138970 of 1973 France .
2496534 of 1981 France .
2657881 of 1978 Germany .
511678 of 1971 Switzerland .

OTHER PUBLICATIONS

Copy of Search Report—European (2 pages).
Copy of Derwent Abstract (1 page) 90–039359 Dec. 1989.
Copy of Derwent Abstract (1 page) 90–264760 Jul. 1990.
Copy of Derwent Abstract (1 page) 80–85043C Oct. 1980.

*Primary Examiner*—Paul R. Michl
*Assistant Examiner*—John J. Guarriello
*Attorney, Agent, or Firm*—Bierman and Muserlian

[57] ABSTRACT

A homogenous non-tacky thermosetting plastic powder mixture formed by mixing component A comprising a solid phenol novolac resin powder and a hardener containing a small amount of an oil-like substance liquid at room temperature with component B comprising a liquid resol, fillers and optionally additives which when containing an abrasive are useful for the production of filler-containing shaped elements or resin-bonded grinding elements.

12 Claims, No Drawings

THERMOSETTING PLASTIC POWDER MIXTURES

STATE OF THE ART

The production of resin-bonded abrasives requires proper coating of the added abrasive grain by the resin and proper bonding in the actual grinding element, so that even high forces can be applied but will not be able to detach the abrasive grain from the composite. Normally, there are used for this purpose pourable phenolic resins which bond well with the filler when various adjuvants are added.

In preparing the mixture, it is customary first to coat the abrasive grain with a liquid phenolic resin, then mixing with the resin powder, possibly adding other abrasive substances or fillers so that a pourable mixture results. To obtain mixtures with constant properties, as needed in particular for pressing operations with pressing machines, they must normally stabilize for some time, as a rule 2 to 12 hours. After this stabilizing time, the mixtures are often agglomerated, so that they must be broken up and screened in an additional costly operation to be ready for use. Also in use are dry mixtures, i.e. without resol addition. Resols can be modified by addition of other substances. As wetting agents, such substances are used also by themselves.

U.S. Pat. No. 1,537,454 describes a manufacture of grinding wheels where furfural as solvent, a plasticizer, and a hardener are added to the phenolic resin. If desired, also a few drops of cresol oil, phenol or cresol may be added. A disadvantage of the addition of furfurol is that thereby not only are the grinding elements coated as desired, but the dry resin particles stick together. For this reason, neutral anthracene oil is used in U.S. Pat. No. 1,803,117 with the abrasive grain being mixed first with the resin powder and the anthracene oil and subsequently with furfurol.

U.S. Pat. No. 2,814,554 deals with the customary use of furfurol in the production of grinding wheels, anthracene oil being used additionally as an anti-dust agent after the mixture of abrasive grains and resin binder has been fully processed. In U.S. Pat. No. 2,825,538, a liquid rubber-like copolymer is mixed with furfurol so that wetting of the abrasive grain and of the phenol resin in the mixture is possible, to which cresol or creosote or guayacol is added in the mixer as an "absorption agent" for the resin particles which have not attached themselves to the abrasive grain particles wetted with furfurol in the liquid rubber. Thereafter, this liquid "absorption agent" is said to prevent the phenomenon known as "bailing."

U.S. Pat. No. 2,943,926 teaches that furfurol together with cresol have been used for a first coating of the resin bond on the abrasive grain in the production of grinding wheels. Lastly, it was possible to mix the resin-coated abrasive grains with creosote oil and liquid resin to form the wheel from the mixture, and then to harden the resin bond. In U.S. Pat. No. 3,784,365, besides furfurol and creosote oil, also fully chlorinated hydrocarbons were added in the production of resin-bonded grinding wheels. Creosote oil is known from the literature as a common anti-dust agent, but to obtain adequate effectiveness, more oil must be introduced than is desirable with respect to the grinding properties. Besides, it is relatively expensive and therefore reduces the profitability of the product. The literature mentions also the addition of xylol, glycol, and the like, but these are too reactive to lead to satisfactory results.

DE-PS 31 49 213 teaches further the addition of hydrocarbon oils of a viscosity of 10 to 2000 mPa.s as wetting agent. Suitable for this purpose are oils which at temperatures $<45°$ C. have little dissolving effect on the phenolic resin. They may be univalent aliphatic alcohols with 6 to 18 carbon atoms or a phenol substituted with alkyl of 6 to 18 carbon atoms or their mixtures, provided the wetting agent is liquid at room temperature. For the manufacture of the grinding elements. the wetting agent may be either mixed with the phenolic resin beforehand, or be added directly during the mixing of all components. A disadvantage here is that unstable compositions are obtained, which also tend to ball when left standing for a short time and are then greatly impaired in their shapability and bonding powder.

OBJECTS OF THE INVENTION

It is an object of the invention to provide inexpensive, pourable, more stable binder mixtures which are dust-free.

It is a further object of the invention to provide thermosetting polymer powder mixtures having good shapability and an improved bond with abrasive grains or fillers to form high-grade shaped elements or grinding elements.

These and other objects and advantages of the invention will become obvious from the following detailed description.

THE INVENTION

The homogenous, non-tacky, thermosetting plastic powder mixtures of the invention are formed by mixing component A comprising a solid phenol novolac resin powder and a hardener containing a small amount of an oil-like substance liquid at room temperature with component B comprising a liquid resol, fillers and optionally additives.

It has been found, surprisingly, that pourable, stable thermosetting mixtures for the production of resin-bonded grinding elements or shaping elements can be obtained by mixing a resin powder, namely a phenol novolac together with a hardener containing a small amount of an oil-like substance liquid at room temperature to form component A, and then processing this pourable non-dusting powder with component B consisting of the fillers or respectively the abrasive grain and other additives, previously mixed intensively with a liquid resol so that a homogeneous non-tacky mixture in powder form is formed. Also, the use of other grain wetting agents is possible, as e.g. creosote oil, furfuryl alcohol, etc. as well as the use of its dry mixtures.

Further it has been found, surprisingly, that the thermosetting mixtures produced with the use of the resin powder of the invention practically no longer requires any curing times as they are distinguished by very constant properties. Owing to this, they offer, besides a longer shelf life, the additional advantage of earlier usability; that is, depending on the oil and the quantity used, they can be processed either immediately or after any desired storage time, the normally necessary operation of breaking and screening being eliminated. Therefore storing the mixtures for the purpose of stabilizing is no longer necessary and the direct usability offers advantages in planning for the mixtures. If needed, new, immediately processable mixtures can be produced in a simple manner so that the production of mixtures in excess, as customary at present, is no longer necessary.

For the production of these mixtures, the resin powder to which the hardener, particularly hexamethylenetetramine, had been admixed, can be mixed with the oil-like substance. Alternatively, the hardener is mixed first with the oil-like substance in which the hardener is not soluble so that the hardener particles are coated with a thin oil film, the resin powder being added only thereafter, and this mixture being then homogenized. In both cases, one obtains by means of this premix in the end a thermosetting mixture which is still pourable even after prolonged storage or transportation times, shapes well, and after processing leads to grinding elements of improved grinding output and stability.

It is advantageous that in this manner a good coating of the fillers or respectively of the abrasive grain by the resol added in liquid form is obtained and at the same time, the high binding power and thermal stability of the phenol novolac can be utilized.

Examples of oil-like substances liquid at room temperature having hydrophobic but non-adhesive properties, but which do not interfere with the hardening reaction, yet act under normal pressure and at room temperature as hydrophobic parting agents. They may be both mineral and animal oils, but also other hydrophobizing substances with polar substituents. Examples of alcohols usable in the invention are hexyl, n-heptyl, lauryl, n-octyl, capryl, n-nonyl, n-decyl, myristyl, cetyl or stearyl alcohol. Preferred are 2-ethylhexanol, decanol, dodecanol, tridecanol, octadecanol and their mixtures. Mixtures are necessary when an alcohol is solid. Generally, this is the case when the carbon chain contains more than 12 carbon atoms.

Also phenols substituted with aliphatic hydrocarbons can be used with a chain length of 6 to 18 carbon atoms being preferred. The substituents are preferably in p-position. Other substituents at the phenol apart from the alkyl groups are not intended in the invention. Examples of phenols are p-n-decyl, p-n-dodecyl, n-octadecyl phenol and other alkyls as indicated in connection with the description of the aliphatic alcohols.

As hydrocarbon oil suitable for the invention is a liquid product of the plant type or from petroleum having a viscosity ranging between 100 and 2000 mPa.s. Preferred are petroleum-base oils in this viscosity range.

Mineral oils, aromatic concentrates, naphthenic oils, diesel oil, terpenes and limonenes are suitable oils, provided the available commercial products have the respective viscosity and no dissolving action. Examples of natural oils are castor oil or cashew oil. Mixtures of alcohol and oil are usable and desirable, particularly if the alcohol is a solid substance.

If oil-like substances solid at room temperature but melting below 60° C. are used, a good hydropobization of the novolac-hardener mixture can be obtained if the mixing occurs at elevated temperatures. Alternatively, the oil-like substance, molten at low temperature, can be applied to the resin-hardener mixture by atomizing and simultaneous intensive mixing.

Usable as novolac for this purpose are all condensation products produced in acid medium on the basis of phenols, cresols and bisphenols with formaldehyde in a molar ratio of phenol to formaldehyde of 1:0.9 to 1:0.2 and a melting point of 50° to 110° C. To operate under mild conditions, mixtures of novolacs of low and higher melting points may be used.

As phenolic components can be used mono- or multinuclear phenols or mixtures of the cited compound class, namely mono- as well as multi-nuclear phenols. Examples are phenol itself, as well as its alkyl-substituted homologs such as o-, m- or p-cresol, xylols or higher alkylated phenols, halogen-substituted phenols such as chloro- or bromo-phenol, and polyvalent phenols such as resorcinol or pyrocatechin, as well as multinuclear phenols such as naphthols, Bisphenol A or Bisphenol F.

The phenol, or the phenolic component, is reacted with formaldehyde or a formaldehyde-eliminating compound to form the desired novolac. The novolacs may be modified by the usual modification substances such as epoxy resins, rubbers, polyvinyl butyral and inorganic additives.

For wetting the fillers or the abrasive grain with a liquid resol, all resols are suitable that are obtained by alkaline condensation of a phenol with formaldehyde or a formaldehyde-eliminating compound. Especially suitable are those resols which are obtained by reaction of a phenol and formaldehyde in the molar ratio of 1:0.7 to 1:4, preferably condensation products with a molar ratio of 1:1.

Usable are those resols which have a monomer content of 0–35%, preferably those with a content of 5 to 20%. In addition, these resols may be modified in the usual manner. All of the above enumerated phenols can be used as phenolic component for the production of the respective resols.

Fillers or respectively abrasive grains such as aluminum oxide, SiC, $FeS_2$, $Na_3$ [$AlF_3$] and/or potassium fluoroborates, finely divided copolymers of vinylidene chloride and vinyl chloride, potassium sulfate, zinc sulfate and barium sulfate can be mixed with the resol.

Component A is produced so that 3 to 16% by weight of hexamethylenetetramine are intensively mixed with 79 to 96.5% by weight of a novolac and thereafter with 0.5 to 5% by weight of an oil-like substance. The mixing may be done by joint grinding, by stirring, or in a suitable commercial mixer. If oil-like substances are used which melt at temperatures only a little above the mixing temperature, it is possible to melt them beforehand and to atomize them in a suitable mixer.

Component B is produced so that 1.5 to 8% by weight, preferably about 5%, are mixed with the abrasive grain or fillers whereby the individual grains or particles are coated entirely with a thin resol film. During the mixing, additives such as silanes, furfuryl aldehyde, etc. can be added in generally customary amounts.

The actual stable thermosetting mixture from which grinding and shaping elements of improved properties can be produced in a known manner by pressing and hardening are obtained when 7 to 14% by weight of component A, the so-called powder resin, are mixed intimately with 86% to 93% by weight of Component B.

In the following examples, there are described several preferred embodiments to illustrate the invention. However, it should be understood that the invention is not intended to be limited to the specific embodiments.

EXAMPLES

For the production of the thermosetting mixtures of the invention, the following resins were used:

RESIN I. Phenol novolac produced by condensation of phenol and formaldehyde in the molar ratio: 1:0.8 (free phenol content: 0.2% by weight)

RESIN II. Phenol novolac produced by condensation of phenol and formaldehyde in the molar ratio: 1:0.72 (free phenol content: 0.2% by weight)

RESIN III. Phenol novolac produced by condensation of phenol and formaldehyde in the molar ratio: 1:0.84 (free phenol content: 0.4% by weight)

RESIN IV. Phenol novolac produced by condensation of phenol and formaldehyde in the molar ratio: 1:0.8 subsequently modified with 10% by weight acrylic nitrile rubber (free phenol content: 0.8% by weight)

RESIN V. Phenol novolac produced by condensation of phenol and formaldehyde in the molar ratio: 1:0.8 subsequently modified with 20% by weight of epoxy resin (free phenol content: 0.8% by weight)

RESIN VI: Cresol novolac produced by condensation of cresol and formaldehyde in the molar ratio: 1:1.1 (free cresol content: 0.9% by weight)

These novolac resins were ground to resin powders with hexamethylenetetramine in the following weight ratios:

TABLE 1

| Ex. | Resin | Parts by wt. | Hexamethylene tetramine, parts by wt. |
|---|---|---|---|
| 1 | I | 94 | 6 |
| 2 | I | 90 | 10 |
| 3 | I | 86 | 14 |
| 4 | II | 90 | 10 |
| 5 | III | 90 | 10 |
| 6 | IV | 90 | 10 |
| 7 | V | 90 | 10 |
| 8 | VI | 90 | 10 |

The resins were ground so that the following finenesses were obtained:

TABLE 2

| | | |
|---|---|---|
| A | 8 to 14% by wt. | >45/u |
| B | 22 to 28% by wt. | >45/u |
| C | 0.5 to 1% by wt. | >45/u |

After the grinding, the resins of Examples 1 to 8 / A to C were mixed homogeneously with 1%, 1.5%, 2% and 4% by weight of paraffin oil and these mixtures were designated in the following by D.

As a variant E of Example 2C, hexamethylenetetramine was first ground alone to a fineness of 0.5 to 1.0% by wt. >45/u and mixed with 15% by wt. of paraffin oil, referred to the amount of hexamethylenetetramine, and then was mixed with the resin.

Grinding wheel mixtures for metal working (M mixtures) were produced by mixing a liquid resol with the abrasive grain and subsequent admixing of the resin powder and of the fillers. To produce such mixtures, the following quantities were mixed together:

| | |
|---|---|
| Liquid resol | 12 kg |
| Grain ($Al_2O_3$) NK 24 | 52 kg |
| Grain ($Al_2O_3$) NK 36 | 128 kg |
| Pyrox | 16 kg |
| Cryolite | 8 kg |
| Resin powder | 27 kg |

In a similar manner, grinding wheel mixtures were produced for stone working (S mixture) by mixing together the following quantities:

| | | |
|---|---|---|
| Liquid resol | 5 kg | |
| Grain (SiC) NK 24 | 25 kg | |
| Grain (SiC) NK 36 | 50 kg | |
| Grain (SiC) NK 46 | 25 kg | |
| Cryolite | 12 kg | |
| Resin powder | 19 kg | Bakelite SW 433 |

TABLE 3

| Resin type | Variant | Paraffin oil content | Result of the M mixtures: Stability hours 12 | 24 | 48 | 72 | 144 | Grinding output 48h mix | Right after prep. |
|---|---|---|---|---|---|---|---|---|---|
| Ex. 1A | D | 2 | + | + | + | + | + | | |
| Ex. 2A | D | 2 | + | + | + | + | + | 2.8 | 2.9 |
| Ex. 2B | D | 2 | + | + | + | + | + | 3.0 | 3.1 |
| Ex. 2C | D | 1 | + | + | + | + | (+) | 3.4 | 3.4 |
| Ex. 3B | D | 2 | + | + | + | + | + | | |
| Ex. 3C | D | 2 | + | + | + | + | + | | |
| Ex. 4B | D | 2 | + | + | + | + | + | | |
| Ex. 5B | D | 2 | + | + | + | + | + | | |
| Ex. 6B | D | 2 | + | + | + | + | + | | |
| Ex. 7B | D | 2 | + | + | + | + | + | 2.7 | 2.0 |
| Ex. 8B | D | 2 | + | + | + | + | + | | |
| Ex, 2A | D | 1.0 | + | + | + | + | (+) | | |
| Ex. 2A | D | 4.0 | + | + | + | + | + | | |
| Ex. 2B | D | 1.5 | + | + | + | + | + | | |
| Ex. 2B | D | 4.0 | + | + | + | + | + | | |
| Ex. 2C | D | 1.5 | + | + | + | + | (−) | | |
| Ex. 2C | D | 4.0 | + | + | + | + | + | | |
| Ex. 2C | F | 1.5 | + | + | + | + | + | | |
| Comparison example without paraffin oil | | | | | | | | | |
| Ex. 2A | | | (+) | (−) | | | | | 2.1 |
| Ex. 2B | | | + | (+) | (−) | | | | 2.3 |
| Ex. 2C | | | + | (+) | (−) | | | | 2.7 |
| Ex. 7B | | | + | (−) | | | | | 2.2 |

+ = pourable
(+) = no longer pourable, but processable (pressable) after mechanical preparation of the grinding wheel mixture
(−) = no longer processable (pressable)
− Coefficient = (weight loss of the material to be treated) / (weight loss of the grinding wheel)

TABLE 4

| Resin type | Variant | Result of the M mixtures, using various oils: Stability 12h | 24h | 48h | 72 | 144h |
|---|---|---|---|---|---|---|
| Ex. 2B | F | + | + | (+) | (−) | |
| Ex. 2B | G | + | + | (+) | (−) | |
| Ex. 2B | H | + | + | + | + | + |
| Ex. 2B | I | + | + | (+) | (−) | |
| Ex. 2B | J | + | + | + | + | (−) |

F After the grinding in Example 2B, 2% by wt. of castor oil was mixed in intensively and homogenized
G Nonylphenol, 2% by wt.
H Anthracene oil. 1.5% by wt.
I Hydrocarbon resin PH 3, 2.5% by wt.
Telura 619 (refined mineral oil), 3.0% by wt.

Various modifications of the compositions and products of the invention may be made without departing from the spirit or scope thereof and it is to be understood that the invention is intended to be limited only as defined in the appended claims.

What we claim is:

1. A homogenous non-tacky thermosetting plastic powder mixture formed by mixing component A consisting essentially of 79 to 96.5% by weight of a solid phenol novolac resin powder and 3 to 16% by weight of a hardener containing 0.5 to 5% by weight of an oily substance liquid at room temperature with component B consisting essentially of a liquid resole, fillers and optionally, additives.

2. A mixture of claim 1 wherein component B also contains grains of an abrasive.

3. A mixture of claim 1 wherein the hardener of Component A is hexamethylenetetramine.

4. A mixture of claim 1 wherein Component A is produced by homogenous mixing of the novolac resin powder with a mixture of the hardener and oily substance.

5. A mixture of claim 1 wherein Component A is formed by first intensively mixing the hardener and oily substance followed by mixing with the novolac resin powder.

6. A mixture of claim 1 wherein Component A contains hexamethylenetetramine as hardener.

7. A mixture of claim 1 wherein the oily substance is paraffin oil.

8. A mixture of claim 1 wherein the substance is at least one member selected from the group consisting of anthracene oil, naphthenic oil, diesel oil, terpenes and limonene, chloroparaffin, n-hexyl alcohol, lauryl alcohol, n-octyl alcohol, capryl alcohol, n-nonyl alcohol, n-decyl alcohol, myristyl alcohol, cetyl alcohol, stearyl alcohol, 2-ethylhexanol, decanol, dodecanol, trideconal, octadecanol, p-n-decyl phenol, p-n-dodecyl phenol, n-octadecylphenol and nonylphenol.

9. A mixture of claim 1 wherein the resol is produced by basic condensation of phenol and formaldehyde in a molar ratio of 1:07 to 1:4 and the abrasive is at least one member selected from the group consisting of aluminum oxide, SiC, $FeS_2$, sodium and potassium fluoroborates, $AlF_3$, a finely divided copolymer vinylidene chloride and vinylchloride, potassium sulfate, zinc sulfate and barium sulfate.

10. A mixture of claim 9 wherein the molar ratio of phenol to formaldehyde is 1:1.

11. A mixture of claim 1 wherein Component B contains 3.5 to 7% by weight of liquid resol.

12. A resin-bonded grinding element made of a mixture of claim 2.

* * * * *